US009039141B2

(12) United States Patent
Stephens et al.

(10) Patent No.: US 9,039,141 B2
(45) Date of Patent: May 26, 2015

(54) FLUIDIC STRUCTURE THAT ALLOWS REMOVAL OF AIR BUBBLES FROM PRINT HEADS WITHOUT GENERATING WASTE INK

(75) Inventors: Terrance Lee Stephens, Molalla, OR (US); Jonathan Robert Brick, Tualatin, OR (US)

(73) Assignee: XEROX CORPORATION, Norwalk, CT (US)

( * ) Notice: Subject to any disclaimer, the term of this patent is extended or adjusted under 35 U.S.C. 154(b) by 235 days.

(21) Appl. No.: 13/468,782

(22) Filed: May 10, 2012

(65) Prior Publication Data

US 2013/0300801 A1 Nov. 14, 2013

(51) Int. Cl.

| | |
|---|---|
| ***B41J 2/135*** | (2006.01) |
| ***B41J 2/015*** | (2006.01) |
| ***B41J 2/19*** | (2006.01) |

(52) U.S. Cl.

CPC ..... *B41J 2/19* (2013.01)

(58) Field of Classification Search

CPC ..... B41J 2002/14169; B41J 29/377; B41J 2/1623; B60K 15/06

USPC ..... 347/20, 93, 94; 137/583

See application file for complete search history.

(56) References Cited

U.S. PATENT DOCUMENTS

| | | | | |
|---|---|---|---|---|
| 4,727,378 | A * | 2/1988 | Le et al. | 347/35 |
| 6,199,976 | B1 * | 3/2001 | Sasada | 347/85 |
| 7,241,000 | B2 * | 7/2007 | Hirota et al. | 347/85 |
| 7,484,837 | B2 * | 2/2009 | Koga et al. | 347/85 |
| 7,604,337 | B2 * | 10/2009 | Koseki | 347/92 |
| 7,625,080 | B2 * | 12/2009 | Hess et al. | 347/92 |
| 7,918,531 | B2 * | 4/2011 | Sugiyama et al. | 347/23 |
| 8,017,186 | B2 * | 9/2011 | Fujii | 427/294 |
| 2002/0033855 | A1 * | 3/2002 | Kubota et al. | 347/19 |
| 2006/0022158 | A1 * | 2/2006 | Feinberg et al. | 251/12 |
| 2006/0181579 | A1 * | 8/2006 | Taira | 347/65 |
| 2009/0284572 | A1 * | 11/2009 | Katoh | 347/85 |
| 2010/0073446 | A1 * | 3/2010 | Shimizu | 347/93 |
| 2011/0057981 | A1 * | 3/2011 | Aruga et al. | 347/20 |
| 2011/0199445 | A1 * | 8/2011 | Ito | 347/93 |
| 2011/0273506 | A1 * | 11/2011 | Katoh | 347/17 |
| 2012/0026220 | A1 * | 2/2012 | Igarashi | 347/6 |
| 2012/0098899 | A1 * | 4/2012 | Xie et al. | 347/85 |

* cited by examiner

*Primary Examiner* — Matthew Luu
*Assistant Examiner* — Patrick King
(74) *Attorney, Agent, or Firm* — Marger Johnson & McCollom PC

(57) ABSTRACT

A fluidic structure has a first chamber having a connection to a fluid reservoir and a connection to an array of apertures, the chamber forming a flow path between the fluid reservoir and the array of apertures, a second chamber having a connection to at least one vent connected to an atmosphere external to the fluidic structure, and at least one path between the first chamber and the second chamber.

18 Claims, 7 Drawing Sheets

FLUIDIC STRUCTURE THAT ALLOWS REMOVAL OF AIR BUBBLES FROM PRINT HEADS WITHOUT GENERATING WASTE INK

Typically, a solid ink print head contains a reservoir into which molten ink is fed using a drip feed, or umbilical feed system. The print head also contains an array of jetting elements that are attached to a nozzle layer having an array of apertures through which ink exits in order to form an image on a print surface. Inside the print head, the ink flows from the reservoir to the jetting elements and nozzle layer through a series of channels or manifolds. These channels or manifolds within the print head are typically formed by a combination of discrete layers that are bonded together in order to form the overall fluidic structure.

Through the use of heaters, the print head is heated such that the solid ink within the print head melts, or becomes liquid during normal operation. During long periods of idleness, or after powering down, the heaters turn off. The associated cooling of the print head causes the ink within the print head to solidify and shrink. This, in turn, causes air to be introduced into the channels or manifolds within the print head. Upon the subsequent power-up, this air manifests itself as air bubbles within the fluidic structure. In order for the print head to perform correctly, all or substantially all of this air must be removed from the channels or manifolds internal to the print head.

One should note that the terms 'printer' and 'print head' apply to any structure or system that produces ink onto a print surface whether part of a printer, a fax machine, a photo printer, etc.

This discussion refers to the process by which the system removes the air from the fluidic structure as a purge cycle. Traditional air removal approaches generate waste ink that the system cannot reclaim or reuse. For example, in one approach, the system transports air bubbles to locations along the channels or manifolds, where they can exit the print head through vent holes that are not part of the nozzle layer. In another approach, the system forces the air through the jetting elements and associated nozzles themselves. In yet another approach, the system forces the air through vents or nozzles within the nozzle layer that are not associated with a jetting element. In each of these approaches, ink trapped between the air bubble and the vent or jetting elements also exits the print head. The printers cannot easily reclaim this ink, and it becomes waste.

With the advent of more stringent energy savings requirements, the printer will be required to power down more frequently than is currently required. Correspondingly, the need for purge cycles in order to remove air introduced into the print head during power down will also increase. This will contribute to more waste ink, resulting in less efficient print heads, higher user costs and unsatisfied customers.

DETAILED DESCRIPTION OF THE EMBODIMENTS

Figure 1:
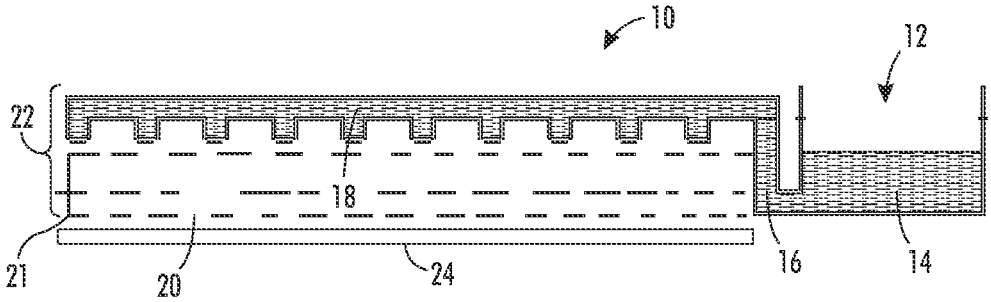
FIGS. 1 and 2 show examples of an ink path through a fluidic structure.

FIG. 1 shows an example of a fluidic structure 10. The fluidic structure may consist of any structure that transports fluid from a reservoir to one or more jetting elements and their associated nozzles. The discussion here will focus on a print head within a print system for ease of understanding, but the embodiments described here may apply to any fluidic structure. No limitation to any particular fluidic structure is intended and none should be implied.

In this example, the fluidic structure connects to a reservoir 12 that contains a fluid 14. In some instances, the reservoir receives a pressure that drives the fluid through channel 16 into chamber 18 within the fluidic structure 10. The fluidic structure may consist of multiple layers 22, also referred to as the jet stack, that when stacked together form manifolds or channels to route ink from the reservoir to an array of jetting elements and their nozzles, also referred to as apertures such as 20. In this example, nozzle layer 21 is shown having several apertures 20. The stack-up of layers may consist of many more layers than shown here, but for purposes of this discussion the layer, or layers forming the chamber 18 and the layer containing the apertures are of the most interest. During printing, fluid is ejected from the nozzles by the jetting elements. In this example ink is ejected by the jetting elements in order to form images on a print substrate such as 24.

Figure 2:
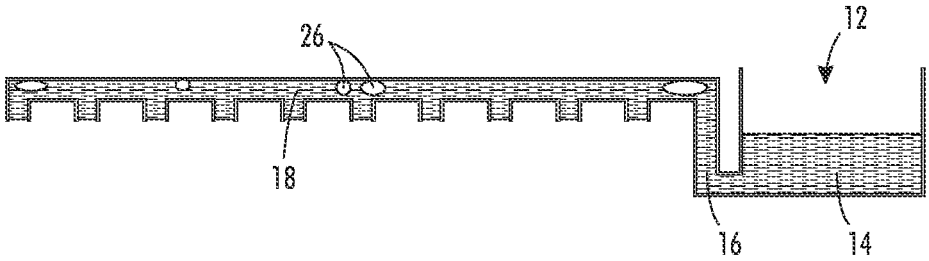

As discussed above, air may be introduced into the fluidic structure during power down cycles of the print head. One should also note that under certain circumstances it is possible for air to be introduced into the fluid structure during normal operation as well. FIG. 2 shows an example of air in the system.

In FIG. 2, one can see that air bubbles, such as 26, have become trapped in the chamber 18. Prior to normal operation, the system needs to remove these air bubbles through the use of a purge cycle. If the system does not remove the bubbles prior to normal operation, they will adversely affect the performance of the fluidic structure. In current fluidic structures, such as that shown in FIGS. 1 and 2, the air bubbles are typically forced to exit directly through vents not within the nozzle layer of FIG. 1, vents within the nozzle layer, or through the jetting elements themselves. In each of these approaches, ink trapped between the air bubble and the vent or jetting elements also exits the print head. The printer cannot easily reclaim this ink and it becomes waste.

Figure 3:
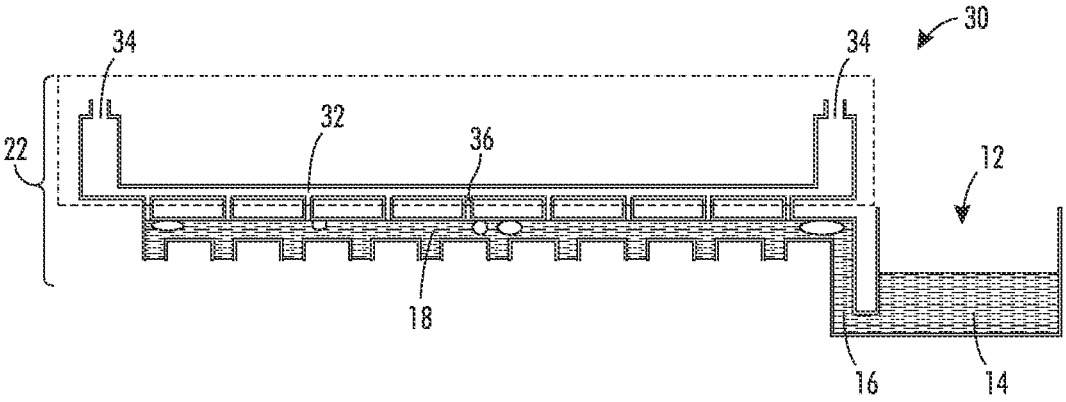
FIG. 3 shows an embodiment of a fluidic structure having a vent chamber.

FIG. 3 shows an embodiment of a fluid structure 30 that includes a second chamber 32, arranged on the side of a first chamber 18 opposite the nozzle layer. The second chamber has at least one vent 34 that connects to an atmosphere external to the print head to allow the bubbles to be vented. One should note that the vents have much larger size than would normally be required to vent air. With the structure 30, during a purge cycle air bubbles and the associated trapped fluid will travel through multiple paths such as 36 to the chamber 32. Through buoyancy, air will be allowed to separate from the fluid within chamber 32 and exit through the vents 34. At the end of the purge cycle, the fluid will return to the chamber 18 via the paths such as 36. This allows recovery of the fluid.

Figure 4:
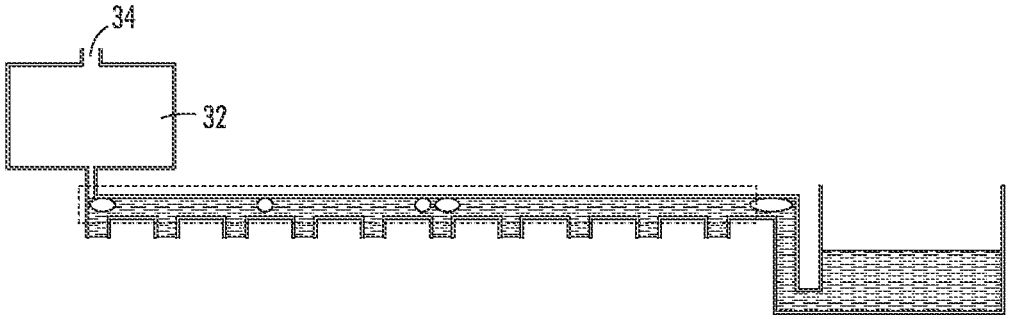
FIG. 4 shows another embodiment of a fluidic structure having a vent chamber.
Figure 5:
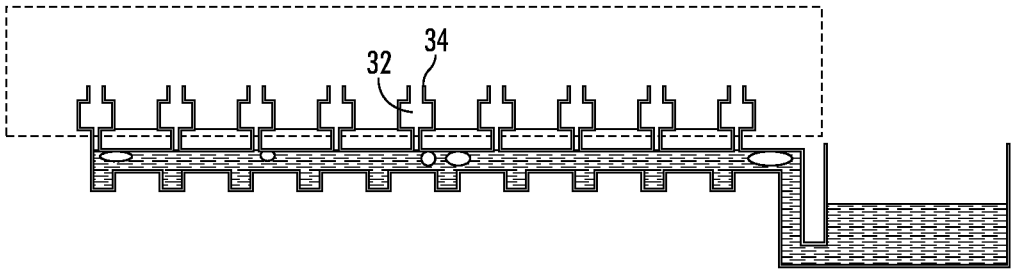
FIG. 5 shows an embodiment of a fluidic structure having multiple vent chambers.

FIG. 4 shows an alternative configuration of the chamber 32 and vent 34. In this embodiment, there is a single chamber 32, as well as a single vent 34. FIG. 5 shows yet another alternative configuration of the chamber 32 and the vent 34. In this embodiment, there are multiple individual second chambers 32, each with a vent 34. The dimensions and relationship between the dimensions of the chambers will depend upon the application or system employing the fluidic structure. For example, the characteristics of the fluid, the needed flow rate, the pressure used, etc., will all impact the chosen configuration of the second chamber or chambers.

Figure 6:
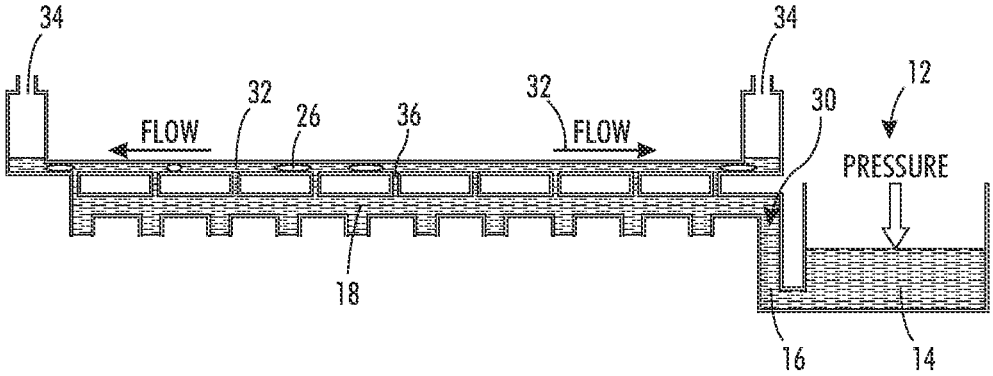
FIGS. 6-9 show portions of a process of venting air bubbles from the fluidic structure.

FIGS. 6-9 show a fluidic structure during a purge cycle. In FIG. 6, the purge cycle begins with application of pressure to the fluid reservoir 12. This causes the fluid 14 to flow through the channel 16 into the chamber 18 and through the paths such as 36 into the second chamber 32. Air bubbles such as 26 will also move with the fluid through the paths 36, and toward the vents 34. One should note that the pressure profile applied during a purge cycle should not cause the fluid to reach the vents 34, and exit the fluidic structure. As will be discussed in more detail further, the dimensions of the chambers, paths, and vents can be controlled to accommodate a desired pressure profile.

Figure 7:
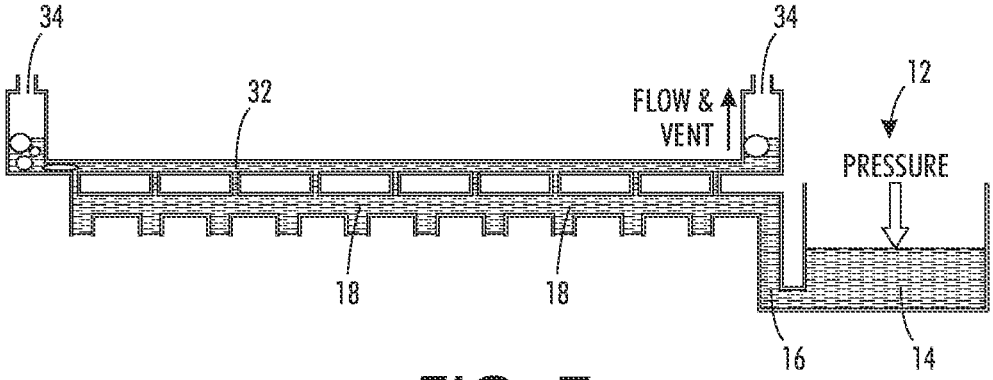

In FIG. 7, the pressure remains on the reservoir 12, and the chamber 18 has become filled with fluid, the air bubbles having been driven into the second chamber 32. The air bubbles have gathered in the vicinity of vents 34 in order to escape to the external atmosphere.

Figure 8:
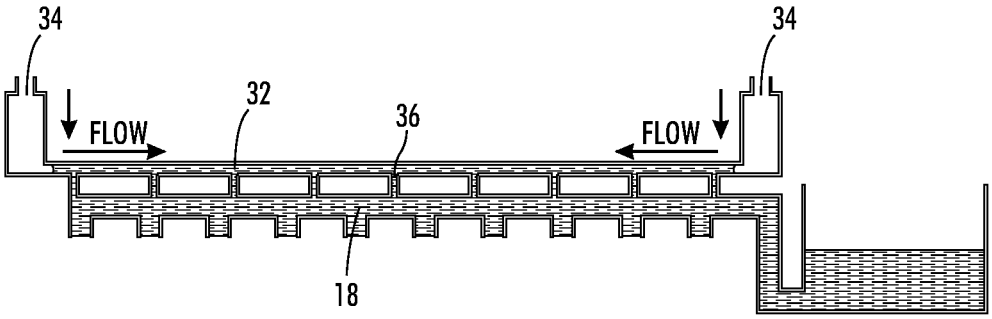
Figure 9:
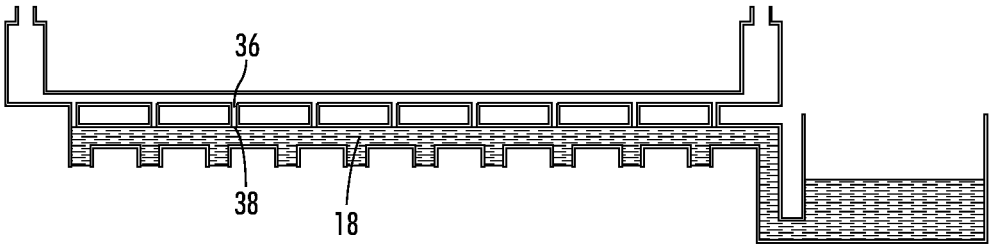

In FIG. 8, the reservoir no longer receives pressure and the flow of the liquid begins to reverse itself. The fluid travels back to the second chamber 32 and then down through the paths such as 36 into the first chamber 18. At the end of the purge cycle, as shown in FIG. 9, the first chamber 18 remains filled with fluid, and the second chamber 32 has become empty. In addition, each path such as 36 has a meniscus 38 that has a sufficient strength to prevent the fluid from flowing into the path 36, or from draining from chamber 18 during normal operation.

Geometric parameters of various components of the fluidic structure affect the ability of the structure to expel air without generating excess waste ink. One such parameter includes the volume of the second chamber, or chambers. As discussed above, the volume of the second chamber needs to accommodate any collateral fluid forced into it during the purge process. Factors that determine the amount of fluid the chamber must accommodate include the amount of time it takes the last bubble to enter the chamber, and the time average flow rate of fluid entering the chamber during the purge process. The product of these two values will give the total volume flow into the chamber, which in turn determines how large the chamber or chambers need to be. For example, the different implementations shown in FIGS. 3, 4, and 5 would necessitate chambers of different volumes. For current solid ink print head designs, the collective volume of the chamber or chambers should be greater than about 0.5 cubic centimeters (ccs).

Additionally, the cross section of the second chamber and vents should not exhibit large capillary action, or support large meniscus strength. This has several effects. First, it allows purged bubbles to float and escape as they approach the vents in the second chamber. Second, it allows purged fluid within the chamber to flow back into the primary fluidic structure without the need for a significant pressure differential between the chamber's vents and the primary fluidic structure, the first chamber. Third, it allows any residual bubbles within the chamber to coalesce and pop during the flow back.

Generally, the smallest dimension in the chamber cross-section will determine the chamber's meniscus strength. For current solid ink print head designs, the meniscus strength of the chamber needs to be less than about 0.25 inches of water. To achieve this, the smallest dimension needs to be greater than about 1 millimeter.

As with the chamber cross-section, the chamber vent or vents need to be sized in order to have low meniscus strength. For current solid ink print head designs, the meniscus strength of the vent or vents should less than about 0.25 inches of water. To achieve this, the smallest cross-sectional dimension of the vent needs to be greater than about 1 millimeter.

Another component of the fluidic structure that should have appropriate size is the flow path, or paths between the first and second chambers. Unlike the second chamber and vents, the flow path, or paths need to possess meniscus strength within a range that prevents draining of the first chamber during ordinary operation, but allows meniscus failure during purging. During ordinary operation, instances arise where negative pressure within the fluidic structure develops due to the action of the jetting elements. The meniscus strength of the flow path needs to resist breakage due to this negative pressure. Alternatively, a positive pressure is developed within the fluidic structure during the purge process. During the purge process, the meniscus strength of the flow path needs to allow for breakage of the meniscus in order for fluid and air to flow into the second chamber, or chambers. For current solid ink print head designs, this meniscus strength needs to fall within the range of 3 to 130 inches of water. Depending upon the shape of the flow path, this requires the smallest dimension to be less than about 125 micrometers but greater than 1.5 micrometers.

Figure 10:
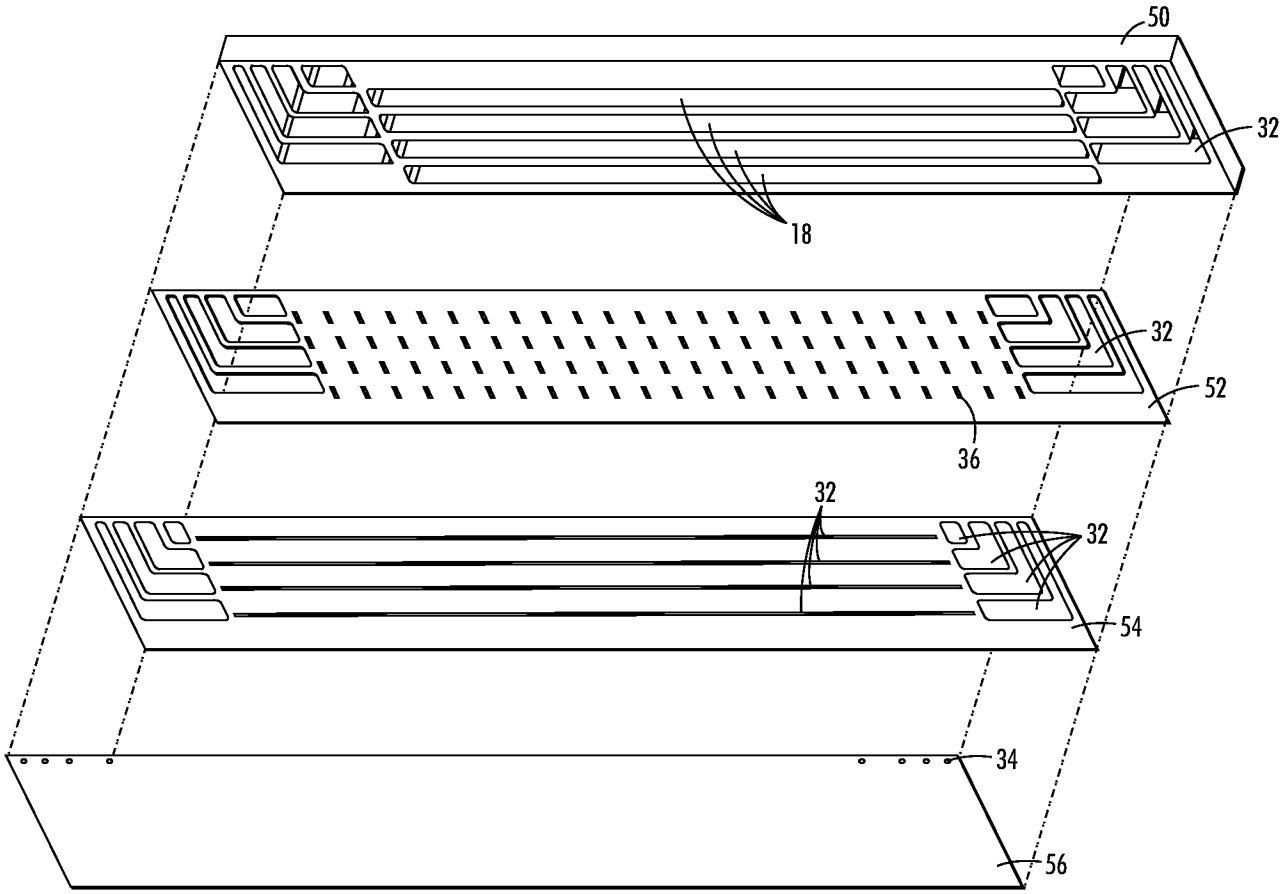
FIG. 10 shows a top view of layers that comprise a fluidic structure having vent chambers.
Figure 11:
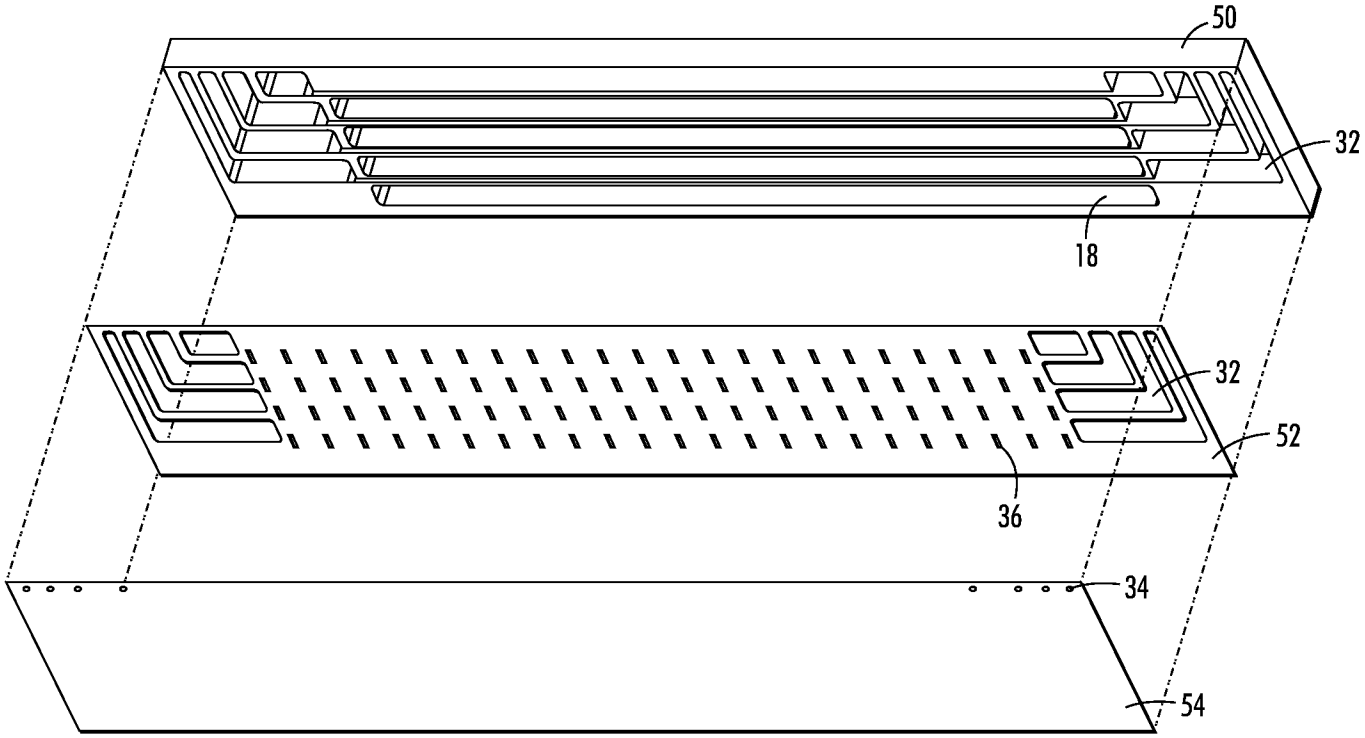
FIG. 11 shows another top view of layers that comprise a fluidic structure having vent chambers.

FIGS. 10 and 11 show embodiments of layers forming the first and second chambers, the flow paths between the chambers, and the vents associated with each of the second chambers. In FIG. 10, the layer 50 contains multiple occurrences of the first chamber 18, as well as multiple occurrences of a portion of the second chamber 32. The layer 54 of the current example contains multiple occurrences of a portion of the second chamber 32. The layer 52 of the current example includes cut outs 36 that form multiple flow paths between each occurrence of the first chamber 18 and the corresponding second chamber 32. The layer 52 also contains multiple occurrences of a portion of the second chamber 32. The layer 56 of the current example contains vents 34 for each occurrence of the second chamber 32. In the current example, it should be noted that the layers 52 and 54 may be comprised of adhesive material. Alternatively, each layer of the example may be affixed to its adjoining layer through other acceptable means FIG. 11 shows an alternative embodiment. In this embodiment, the layer 50 contains multiple occurrences of the first chamber 18, as well as multiple occurrences of a portion of the second chamber 32. The layer 52 of the current example includes cut outs 36 that form multiple flow paths between each occurrence of the first chamber 18 and the corresponding second chamber 32 within layer 50. The layer 52 also contains multiple occurrences of a portion of the second chamber 32. The layer 54 of the current example contains vents 34 for each of the second chambers 32. In the current example, it should be noted that the layer 52 may be comprised of adhesive material. Alternatively, each layer of the example may be affixed to its adjoining layer through other acceptable means.

One should note that these consist of merely representative implementations and no intention exists to restrict the scope of the embodiments to these examples.

It will be appreciated that several of the above-disclosed and other features and functions, or alternatives thereof, may be desirably combined into many other different systems or applications. Also that various presently unforeseen or unanticipated alternatives, modifications, variations, or improvements therein may be subsequently made by those skilled in the art which are also intended to be encompassed by the following claims.

What is claimed is:

1. A fluidic structure having multiple layers, comprising:

a first chamber formed from the multiple layers having a connection to a fluid reservoir and a connection to an array of apertures, the first chamber forming a flow path between the fluid reservoir and the array of apertures;

a second chamber formed from the multiple layers having a connection to at least two vents connected to an atmosphere external to the fluidic structure; and at least one path between the first chamber and the second chamber;

wherein during a purging cycle, fluid flowing through the first and second chambers does not enter any of the vents.

2. The fluidic structure of claim 1, wherein the second chamber has a volume sufficient to accommodate collateral fluid forced into it during a purge process.

3. The fluidic structure of claim 1, wherein the second chamber forms a flow path parallel to the flow path in the first chamber.

4. The fluidic structure of claim 1, wherein the second chamber has a cross section selected to prevent capillary action.

5. The fluidic structure of claim 1, wherein the second chamber has a cross section that results in a meniscus strength along an entire length of the second chamber less than 0.25 inches of water.

6. The fluidic structure of claim 1, wherein the vent in the second chamber has a meniscus strength of less than 0.25 inches of water.

7. The fluidic structure of claim 1, wherein the at least one path has a meniscus strength that prevents draining of the first chamber during operation of the fluidic structure but allows meniscus failure during a purge cycle.

8. The fluidic structure of claim 7, wherein the at least one path has a meniscus strength in the range of 3 to 130 inches of water.

9. A print head having a reservoir and multiple layers, the multiple layers, comprising:

a first chamber connected to an ink reservoir to receive ink, the multiple layers forming a flow path between the fluid reservoir and an array of apertures, the array of apertures arranged to expel ink from the jet stack to a print substrate;

a second chamber formed from the multiple layers, the second chamber arranged on a side of the first chamber opposite a side adjacent to the array of apertures, the second chamber having at least two vents connected to an atmosphere external to the jet stack; and at least one path for the ink between the first chamber and the second chamber;

wherein during a purging cycle, fluid flowing through the first and second chambers does not enter any of the vents and upon completion of the purging cycle the second chamber is substantially free from fluid.

10. The print head of claim 9, the print head further comprising part of a solid ink jet printer.

11. The print head of claim 9, further comprising an adhesive layer between a layer in the jet stack forming the first chamber and a layer in the jet stack forming the second chamber.

12. The print head of claim 11, wherein the at least one path comprises cutouts in the adhesive layer.

13. A print head, comprising:

a nozzle layer having an array of apertures arranged to allow ink to exit the print head to a print substrate;

a first layer forming a first chamber having a connection to an ink reservoir and the array of apertures;

a second layer forming a second chamber having at least two vents to an atmosphere external to the print head, the second layer being arranged on a side of the first layer opposite the nozzle layer;

an adhesive layer between the first layer and the second layer; and at least one ink path between the first chamber and the second chamber;

wherein during a purging cycle, fluid flowing through the first and second chambers does not enter any of the vents and upon completion of the purging cycle the second chamber is substantially free from fluid.

14. The print head of claim 13, wherein the second chamber has a volume sufficient to accommodate collateral fluid forced into it during a purge process.

15. The print head of claim 13, wherein the second chamber forms a flow path parallel to a flow path in the first chamber.

16. The print head of claim 13, wherein the second chamber has a cross section selected to prevent capillary action.

17. The print head of claim 13, wherein the at least one path has a meniscus strength that prevents draining of the first chamber during operation of the print head but allows meniscus failure during a purge cycle.

18. The fluidic structure of claim 1, wherein upon completion of the purging cycle the second chamber is substantially free from fluid.

* * * * *